US008544997B2

(12) United States Patent
Kurosu et al.

(10) Patent No.: US 8,544,997 B2
(45) Date of Patent: Oct. 1, 2013

(54) LIQUID EJECTION HEAD AND MANUFACTURING METHOD THEREOF

(75) Inventors: Toshiaki Kurosu, Kawasaki (JP); Koji Sasaki, Nagareyama (JP); Kouji Hasegawa, Kawasaki (JP); Satoshi Ibe, Yokohama (JP); Yoshinori Tagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/420,834

(22) Filed: Mar. 15, 2012

(65) Prior Publication Data

US 2012/0242747 A1 Sep. 27, 2012

(30) Foreign Application Priority Data

Mar. 23, 2011 (JP) ..... 2011-064162

(51) Int. Cl.
*B41J 2/17* (2006.01)

(52) U.S. Cl.
USPC ..... 347/93

(58) Field of Classification Search
USPC ..... 347/93
See application file for complete search history.

(56) References Cited

U.S. PATENT DOCUMENTS

| | | | | |
|---|---|---|---|---|
| 6,520,632 | B1 * | 2/2003 | Yamazaki et al. | 347/92 |
| 7,287,847 | B2 | 10/2007 | Fujii et al. | |
| 7,901,064 | B2 | 3/2011 | Urayama et al. | |
| 7,959,277 | B2 * | 6/2011 | Freitag et al. | 347/88 |

FOREIGN PATENT DOCUMENTS

| | | | |
|---|---|---|---|
| EP | 0 609 860 | B1 | 6/1998 |
| JP | 06-286149 | A | 10/1994 |
| JP | 2005-178364 | A | 7/2005 |

* cited by examiner

*Primary Examiner* — Lamson Nguyen
(74) *Attorney, Agent, or Firm* — Fitzpatrick, Cella, Harper & Scinto

(57) ABSTRACT

Provided is a liquid ejection head, including: an ejection orifice forming member having an ejection orifice for ejecting liquid; a substrate having a supply port for supplying the liquid to the ejection orifice; and a filter disposed at a position upstream of the ejection orifice when the liquid is supplied to the ejection orifice, in which the filter includes an opening having a diameter smaller than or equal to a diameter of the ejection orifice, and a tapered shape structure disposed at a position upstream of the opening when the liquid is supplied to the ejection orifice, the tapered shape structure having a distal end directed toward an upstream side.

3 Claims, 4 Drawing Sheets

LIQUID EJECTION HEAD AND MANUFACTURING METHOD THEREOF

BACKGROUND OF THE INVENTION

1. Field of the Invention

The present invention relates to a liquid ejection head and a manufacturing method thereof.

2. Description of the Related Art

As an example of a liquid ejection head for ejecting liquid, there is known an ink jet recording head used for an ink jet printing method in which small ink droplets are ejected and applied to a recording medium such as paper.

With the advancement of the recording technologies in recent years, for the ink jet recording head, it is required that the density of array of ejection orifices for ejecting ink should be made higher, and the shapes of the ejection orifices and flow paths communicating thereto should be fabricated more minutely. Japanese Patent Application Laid-Open No. H06-286149 discloses a method of manufacturing a liquid ejection head in which a nozzle layer is formed on a silicon wafer, which has been provided in advance with heater elements and driving circuits, with a resin which can be patterned by photolithography.

However, as the diameter of the ink ejection orifice becomes smaller for addressing a further degree of microfabrication, the ink ejection orifice, which is fabricated more minutely, may be clogged with dust in ink, thereby hindering normal ejection.

For addressing this problem, Japanese Patent Application Laid-Open No. 2005-178364 discloses, for collecting dust in ink, a nozzle structure provided with a filter part having an opening diameter smaller than an opening diameter of an ink ejection orifice. More concretely, there is disclosed a nozzle structure for collecting dust in ink by providing a free standing monolayer film (so called membrane) between a substrate on which driving circuits are formed and a nozzle layer, and forming through holes in the film.

However, the conventional filter structure collects dust in ink on the surface of the filter, and hence dust is apt to reach the through holes of the filter. Therefore, after collecting dust, as illustrated in FIG. 5, the through holes of the filter may be clogged with dust 10. This decreases the ink flow rate to decrease the supply rate of the ink required for ejection. As a result, blurs and unevenness of printed images may be caused.

SUMMARY OF THE INVENTION

Therefore, it is an object of the present invention to provide a liquid ejection head capable of preventing clogging of a filter when dust and foreign matters in liquid are collected, thereby performing stable ejection of liquid without decreasing the liquid flow rate even after collecting dust, and also provide a manufacturing method of the liquid ejection head.

The present invention has been accomplished in view of the above-mentioned problems, and has the following features.

According to a first aspect of the present invention, there is provided a liquid ejection head, including: an ejection orifice forming member having an ejection orifice for ejecting liquid; a substrate having a supply port for supplying the liquid to the ejection orifice; and a filter disposed at a position upstream of the ejection orifice when the liquid is supplied to the ejection orifice, in which the filter includes an opening having a diameter smaller than or equal to a diameter of the ejection orifice, and a tapered shape structure disposed at a position upstream of the opening when the liquid is supplied to the ejection orifice, the tapered shape structure having a distal end directed toward an upstream side.

According to a second aspect of the present invention, there is provided a method of manufacturing the above-mentioned liquid ejection head, which includes the steps of:

i) forming, on a substrate having an energy generating element, a resin pattern for defining a shape of the tapered shape structure;

ii) covering the resin pattern with a material layer and forming an opening in the material layer, thereby forming a filter layer;

iii) forming, on the filter layer, a mold for forming a liquid flow path;

iv) covering the mold with a photosensitive resin layer and forming an ejection orifice in the photosensitive resin layer;

v) removing the mold for forming the liquid flow path; and vi) forming a liquid supply port in the substrate.

Further features of the present invention will become apparent from the following description of exemplary embodiments with reference to the attached drawings.

BRIEF DESCRIPTION OF THE DRAWINGS

FIGS. 1A and 1B are diagrams illustrating an example of a liquid ejection head according to the present invention, in which FIG. 1A is a top view and FIG. 1B is a cross-sectional perspective view taken along line 1B-1B in FIG. 1A.

DESCRIPTION OF THE EMBODIMENT

A liquid ejection head according to the present invention is described with reference to FIGS. 1A and 1B.

Incidentally, as liquid, for example, ink and processing liquid for adjusting printability of ink may be used. The liquid ejection head of the present invention may be used as, for example, an ink jet recording head and an ejection head for conductive paste for forming circuits.

Further, the liquid ejection head may include a nozzle tip and a tip plate on which the nozzle tip is mounted. The nozzle tip includes a covering resin layer having multiple ejection orifices and liquid flow paths and a substrate having energy generating elements and a liquid supply port. The following description focuses on the nozzle tip.

Figure 1A:
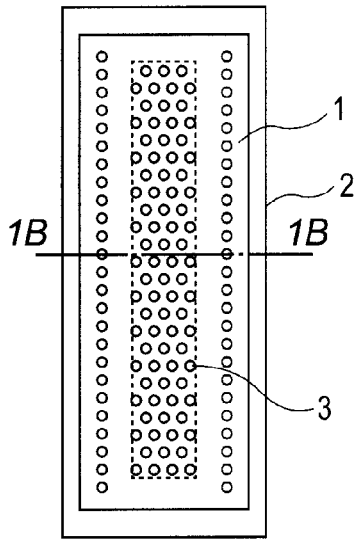
Figure 1B:
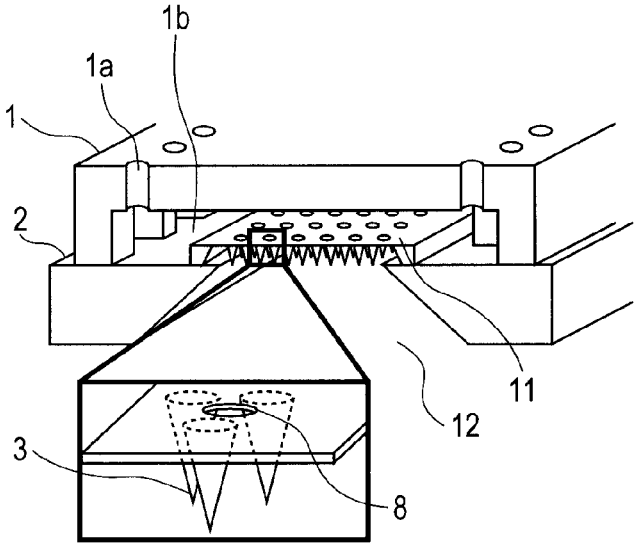

FIGS. 1A and 1B are schematic diagrams illustrating an example of the liquid ejection head (more concretely a nozzle tip) according to the present invention. More concretely, FIG. 1A is a top view of the liquid ejection head, and FIG. 1B is a cross-sectional perspective view of the liquid ejection head illustrated in FIG. 1A taken along line 1B-1B of FIG. 1A and perpendicular to a substrate 2. The nozzle tip includes a nozzle layer 1, the substrate 2, and a filter 11.

In the liquid ejection head illustrated in FIGS. 1A and 1B, the nozzle layer 1 as a covering resin layer is disposed on a surface of the substrate 2 on which energy generating elements for generating energy used for ejecting liquid (e.g., ink) and driving circuits for heating the liquid to generate a bubble therein are formed. The nozzle layer 1 includes multiple ejection orifices 1*a* for ejecting liquid, and a liquid flow path 1*b* (e.g., ink flow path) communicating with the respective ejection orifices. As the energy generating element, for example, a heater element or a piezoelectric element may be used. As the driving circuit, a voltage-controlled semiconductor element, typically a bipolar transistor, or a current-controlled semiconductor element, e.g., a power transistor, may be used.

The substrate 2 includes a liquid supply port 12 (e.g., an ink supply port) communicating with the liquid flow path 1*b*. Moreover, the filter 11 is disposed between the nozzle layer 1 and the substrate 2, more concretely, between the liquid flow path 1*b* and the liquid supply port 12. The filter 11 is disposed at a position upstream of the ejection orifices in the flowing direction of ink supplied to the ejection orifices. This filter 11 has tapered shape structures 3 for collecting dust in liquid, and openings 8 for ensuring a liquid flow rate through which liquid passes even after collecting dust. In FIG. 1B, the opening 8 penetrates the filter 11 perpendicularly thereto. Liquid (e.g., ink) supplied to the liquid supply port 12 flows into the liquid flow path 1*b* via the openings 8 to be ejected from the ejection orifices 1*a*. Therefore, through the adjustment of the number, arrangement and shapes, etc., of the openings 8, the flow rate of liquid supplied to the liquid flow path 1*b* can be adjusted.

The substrate 2 and a surface 11*a* of the filter layer on the tapered shape structure side in which the openings 8 are formed are parallel to each other. In the filter 11 illustrated in FIGS. 1A to 2B, the tapered shape structures 3 are disposed at positions upstream of the openings 8 in the flowing direction of liquid to be supplied to the ejection orifices. Namely, the tapered shape structures 3 are formed on the substrate side with respect to the openings 8, more concretely, on the liquid supply port 12 side. The side surface of the tapered shape structure 3 is inclined with respect to the substrate 2 and the surface 11*a*. The tapered shape structure has a shape gradually decreasing in size toward its distal end (tapered shape). The sectional area thereof when cut parallel to the substrate 2 gradually decreases as approaching the substrate 2. The distal end of the protruding body (the portion having the smallest sectional area) is positioned nearer to the liquid supply port than the root thereof (the portion having the largest sectional area).

The tapered shape structure 3 may be disposed perpendicularly to the substrate, and in FIGS. 1A to 2B, the distal end of the protruding body is directed toward the liquid supply port 12 (the downward direction on the drawing of FIG. 1B). Alternatively, the tapered shape structure 3 may be disposed to be inclined with respect to the substrate. Namely, the distal end thereof may be directed in a lower left direction or a lower right direction in the drawing of FIG. 1B.

With the filter 11 disposed between the liquid supply port 12 and the liquid flow path 1*b*, ink supplied from a tank always passes through the filter 11 before reaching the liquid flow path 1*b*, more concretely, energy action chambers (e.g., bubbling chambers). Therefore, dust in ink can be reliably collected with the tapered shape structures 3 so that only the ink from which dust has been removed can pass through the openings 8 to be supplied to the bubbling chamber.

The energy action chamber means a space for temporarily storing the ink to be ejected. In this energy action chamber, energy from the energy generating element acts on the liquid (ink). The bubbling chamber means an energy action chamber in the case where ink is ejected with a bubble generated by a heater element or the like.

In this case, because the tapered shape structure 3 for collecting dust has a tapered shape, the distance between two tapered shape structures 3 adjacent to each other can be varied in the direction perpendicular to the substrate 2, instead of a constant distance. With this, the place where dust in ink is collected can be varied in accordance with the size of dust so that dust in ink can be collected in a three-dimensional way.

Figure 4A:
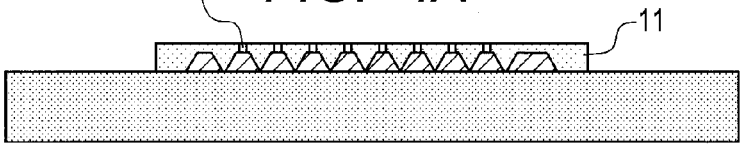
FIGS. 4A, 4B, 4C, 4D and 4E are diagrams illustrating the steps of an example of the method of manufacturing a liquid ejection head according to the present invention.
Figure 4B:
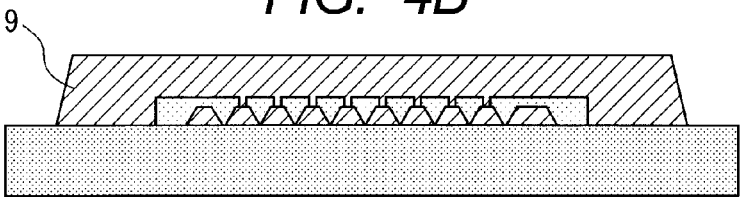
Figure 4C:
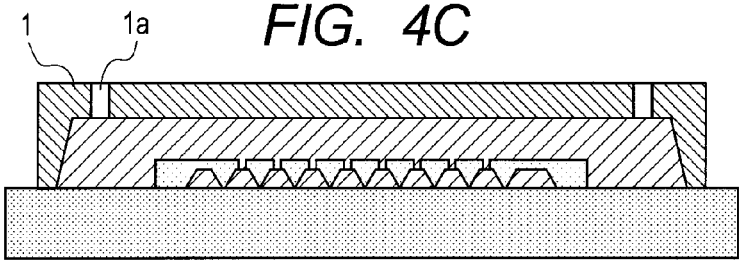
Figure 4D:
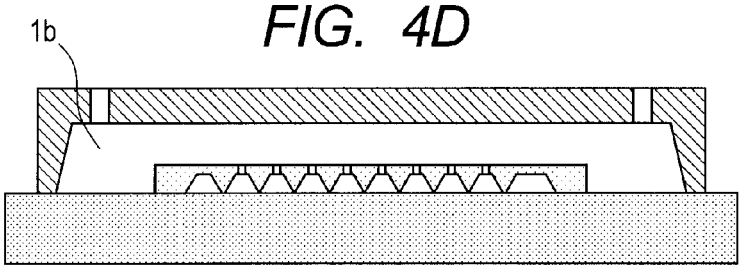
Figure 4E:
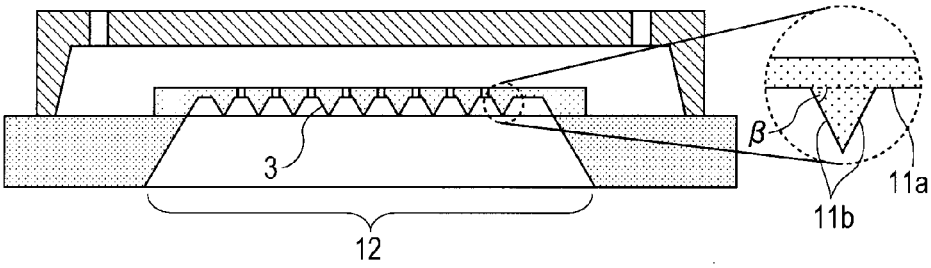
Figure 5:
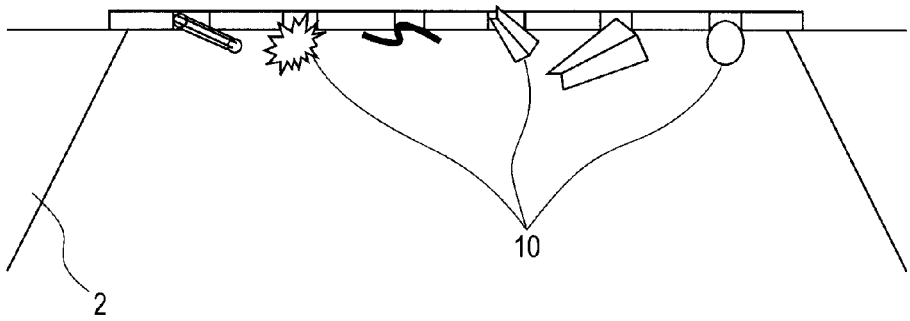
FIG. 5 is a cross-sectional view for illustrating a conventional filter structure.

As illustrated in FIG. 4E, it is preferred that the angle (180°-β) formed by a side surface 11*b* of the tapered shape structure 3 and the surface 11*a* outside the tapered shape structure 3 be an obtuse angle.

Figure 2A:
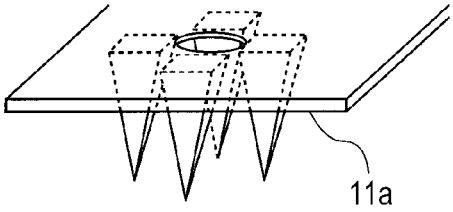
FIGS. 2A and 2B are diagrams illustrating examples of a filter layer.
Figure 2B:
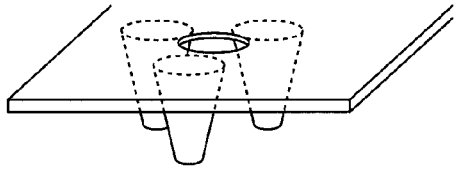

The tapered shape structure 3 may be formed as a cone structure having, for example, a conical shape as illustrated in FIG. 1B or a pyramid shape as illustrated in FIG. 2A, or such a shape as illustrated in FIG. 2B that has a flat distal end of the projection of the cone structure.

For easily collecting dust, preferably, three or more tapered shape structures 3 are disposed for one opening for ensuring the liquid flow rate so that respective protruding bodies are formed to surround the opening 8.

In the present invention, the opening 8 is formed to have an opening diameter smaller than or equal to the opening diameter of the ejection orifice 1*a*. With this, dust having a size small enough to pass through the opening 8 can be discharged through the ejection orifice 1*a* together with ink when the ink is ejected, thereby preventing the nozzles from being clogged with dust. The opening 8 is preferably formed to have an opening diameter smaller than the diameter of the ejection orifice 1*a*.

When the multiple ejection orifices have different opening diameters from one another, the opening diameters of all the openings 8 may be set to be smaller than or equal to the smallest diameter among the ejection orifices. Moreover, for easily preventing the nozzles from being clogged with dust, the largest diameter in the opening portion of the opening 8 is preferably set to be smaller than or equal to the smallest diameter in the opening portion of the ejection orifice 1*a*. Further, FIGS. 1A and 1B illustrate the form in which the diameter of the ink flow path 1*b* is larger than or equal to the diameter of the ejection orifice. However, when the diameter of the ink flow path is smaller than the diameter of the ejection orifice, for easily preventing the nozzles from being clogged with dust, the opening diameter of the opening may be set to be smaller than or equal to the diameter of the ink flow path.

Moreover, the opening diameter of the opening 8 may be set to be smaller than or equal to the opening diameter of the ink ejection orifice, and the shape of the opening may be optionally varied within this range. For example, when the openings are formed by photolithography, the opening diameters thereof can be respectively changed through the use of multiple patterns of opening diameters on its mask pattern. Note that, the respective opening diameters can be determined with, for example, an image processing apparatus which performs image analysis to a microscopic image or an interference image.

As illustrated in FIGS. 1A and 1B, in the liquid ejection head of the present invention, the ejection orifices 1*a* having the same shape (e.g., a column) may be disposed at the same interval. Moreover, the openings 8 having the same shape (e.g., a column) may be disposed at the same interval.

Hereinafter, an example of a manufacturing method of a liquid ejection head according to the present invention is described.

FIGS. 3A to 4E are schematic cross-sectional views for illustrating the example of the method of manufacturing the liquid ejection head according to the present invention. Similarly to FIG. 1B, those diagrams are cross-sectional views of the liquid ejection head taken along line 1B-1B and illustrate the sections in respective steps. Hereinafter, referring to FIGS. 3A to 4E, the respective steps of the manufacturing method of the present invention are described.

Figure 3A:
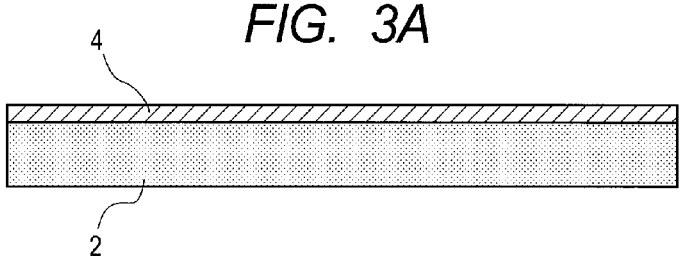
FIGS. 3A, 3B, 3C, 3D and 3E are diagrams illustrating the steps of an example of the method of manufacturing a liquid ejection head according to the present invention.

First, as the substrate 2 having energy generating elements, for example, a Si wafer (heater board) on which circuits for heating ink to be ejected are formed is prepared. A resist layer 4 for forming the shapes of the tapered shape structures 3 used in the present invention is formed on the substrate (FIG. 3A). As the resist layer 4, for example, a known photosensitive resin layer used in photolithography may be used. More concretely, a positive type resist for semiconductors, such as OFPR (trade name; produced by TOKYO OHKA KOGYO CO., LTD.), may be used. As a method of forming the resist layer 4, a spin-coating method, a slit-coating method, etc., can be suitably selected in accordance with the required film thickness and the forming conditions.

Figure 3B:
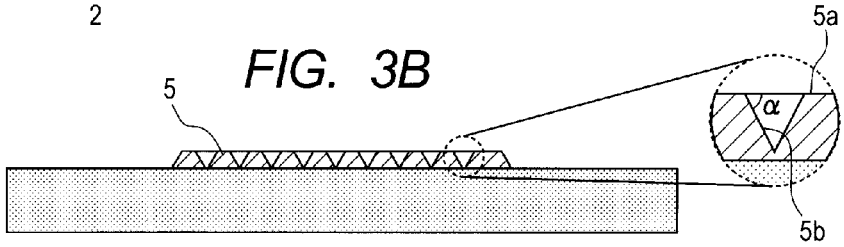

This resist layer 4 is patterned by photolithography to form an opening pattern (resin pattern) 5 (Step 1, FIG. 3B). The opening pattern 5 may be formed directly on the substrate 2 having the energy generating elements. Alternatively, another layer may be formed between the substrate 2 and the opening pattern 5.

This opening pattern 5 functions as a mold for defining the shapes of the tapered shape structures 3. The shapes of the tapered shape structures 3 are defined by the film thickness of the opening pattern 5 and the tapering angle $\alpha$. The shape of the opening pattern 5, more concretely, the shape of the recess formed in the resist layer 4 (e.g., the conical shape), may be consistent with the shape of the tapered shape structure 3. Note that, the tapering angle $\alpha$ means, as illustrated in FIG. 3B, an angle formed by a side surface 5*b* of the recess in the resist layer 4 formed by the patterning and a surface 5*a* of the resist layer 4 having the recess. The tapering angle $\alpha$ may be consistent with the angle (tapering angle $\beta$) which is formed by the side surface 11*b* of the tapered shape structure 3 and the surface 11*a* in the protruding body as illustrated in FIG. 4E.

Therefore, through appropriate adjustment of the film thickness of the resist layer 4 and the tapering angle $\alpha$ of the opening pattern 5, the height of the tapered shape structure 3 and the tapering angle $\beta$ can be set to desired values.

For example, if the conical type tapered shape structure 3 is used, the ejection orifice is 15 μm in diameter, the tapered shape structure 3 is 5 μm in height, the tapering angle $\beta$ is 60°, and the distance between the roots of two protruding bodies adjacent to each other is 14 μm, then the distance between the distal ends of the protruding bodies is about 20 μm. Accordingly, from the root of the protruding body to the distal end thereof, there can be provided a gap of 14 μm to 20 μm between two tapered shape structures 3 adjacent to each other. When those tapered shape structures 3 are used, dust having a diameter of more than 20 μm is stopped at the distal ends of the protruding bodies, and dust having a diameter of 14 μm to 20 μm is caught in the gap in accordance with its size. On the other hand, ink can pass through the gaps and pass through the openings 8, which are formed later, so that a stable flow rate of ink can be ensured. In this case, dust having a diameter of less than 14 μm passes through the gap between the protruding bodies. However, the diameter of the ink ejection orifice is 15 μm, and hence the dust is ejected simultaneously with ink ejection without being caught in the ejection orifice.

Figure 3C:
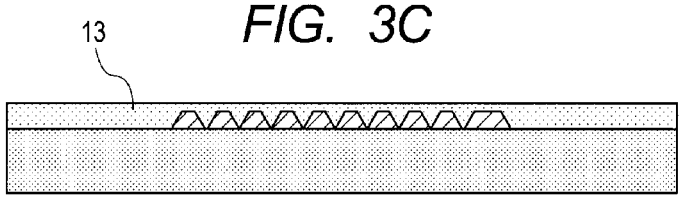

Next, a material layer 13 is formed on this opening pattern 5 (FIG. 3C). The material layer 13 constituting tapered structural bodies (tapered shape structures 3) is required to have chemical stability high enough to prevent corrosion due to ink and have mechanical strength high enough to prevent damage due to the flow of ink and dust in the ink. It is preferred that the material of the material layer 13 enhance the adhesive force between the nozzle layer 1 and the substrate 2. As the material layer 13, for example, a spin-on-glass (SOG) film and an organic film such as of polymethyl methacrylate may be used. The thickness of the material layer 13 is desirably optimized in accordance with the stress of the material constituting the nozzle, provided that the mechanical strength required for the filter can be ensured, and the flowing resistance of ink is not lowered, concretely, in the range of thickness where no damage is caused due to the internal stress in the member constituting the nozzle.

Next, in the thus formed material layer 13, the openings 8 for ensuring the ink flow rate are formed to form the filter 11 (Step 2, FIGS. 3D to 4A). The method of forming the openings 8 can be suitably selected from a wet etching method, a dry etching method, photolithography, and other such methods in accordance with the material constituting the filter 11.

For example, when a negative type resist is used as the material constituting the filter 11, the dust filter layer can be directly patterned by photolithography. Moreover, when an organic resin layer, which is unsuitable for the patterning by photolithography, is used as the material constituting the filter 11, the following process can be used. Namely, as illustrated in FIGS. 3D to 4A, first, a resist pattern 7*a* is formed in a resist layer 7 which has been additionally formed as an etching mask. Then, the openings 8 can be formed through a physical process, such as ion etching, or a chemical process using an etchant. Note that, in the filter 11, two tapered shape structures 3 adjacent to each other can be formed with a space therebetween. Then, the openings 8 can be formed at the portions where the tapered shape structures 3 are not formed (for example, between two tapered shape structures 3 adjacent to each other).

The opening shape of the opening 8 formed in the material layer 13 can be suitably changed. However, it is desired that the opening shape be formed of a curved portion (be circular or elliptic).

For ensuring the ink flow rate required for ejecting ink, it is desired that the total opening area of the openings 8 be larger than or equal to the total opening area of the ink ejection orifices. For example, when the opening area of each ink ejection orifice formed in the nozzle layer 1 is 200 $\mu m^2$ and the total number of the ink ejection orifices is 1,000, the total opening area of the ink ejection orifices is 200 $\mu m^2 \times 1,000 = 200,000\ \mu m^2$. In this case, when the total opening area of the openings formed in the material layer 13 is set to be more than or equal to 200,000 $\mu m^2$, the flow rate of ink supply is always larger than the maximum flow rate required for ejecting ink so that ink can be stably ejected.

As described above, it is desired that the opening 8 formed in the material layer 13 be formed at a position surrounded by three or more tapered shape structures 3. With three or more tapered shape structures 3 provided around the opening 8, dust in ink can be easily collected in the gap between the tapered shape structures. Accordingly, it is easy to prevent dust from reaching the opening 8 to clog the opening 8.

Next, on the filter layer formed through the above-mentioned steps, a mold 9 for forming an ink flow path is formed (Step 3, FIG. 4B). As the mold 9, for example, polymethyl isopropenyl ketone (trade name ODUR-1010, produced by TOKYO OHKA KOGYO CO., LTD.) may be used. Note that, the mold 9 can be formed directly on the surface of the filter 11.

After that, the mold is covered with a photosensitive resin layer. Then, the ink ejection orifices 1*a* are formed in this photosensitive resin layer so as to form the nozzle layer 1 having the ejection orifices 1*a* (Step 4, FIG. 4C). In the present invention, the filter 11 may be provided with a function as a layer for enhancing adhesiveness between the nozzle layer 1 and the substrate so as to bring the filter layer and the nozzle layer into close contact with each other. Therefore, the material constituting the nozzle layer 1 is desired to ensure adhesiveness with the filter 11. Moreover, if the filter layer does not function as a layer for enhancing adhesiveness, the material constituting the nozzle layer 1 may be the same as the material constituting the filter 11. The photosensitive resin layer may be formed directly on the surface of the mold 9.

When the adhesiveness between the nozzle layer 1 and the filter 11 is low, a layer for enhancing the adhesiveness may be additionally disposed between the nozzle layer 1 and the filter 11.

Next, the mold 9 and the opening pattern 5 are immersed into solution for removing the mold 9 and the opening pattern 5 so as to be eluted through the ejection orifices 1*a* to form the ink flow paths 1*b* (FIG. 4D). As the processing liquid, for example, methyl lactate may be used.

After the above-mentioned steps, a nozzle part in which the filter 11 having the tapered shape structures 3 is formed is completed. Note that, the nozzle part means flow paths through which ink passes to be ejected as liquid droplets.

Then, the ink supply port 12 is formed in the substrate 2 to complete the nozzle tip having the tapered shape structures 3 (Step 5, FIG. 4E). Note that, as a method of forming the ink supply port, for example, a method of etching silicon using potassium hydroxide solution, or if alkali contamination is concerned, organic alkaline solution, such as tetramethylammonium hydroxide, or a plasma etching method using fluorocarbon gas or the like can be used.

As an example, an ink jet recording head was manufactured.

Example 1

Hereinafter, an example of the present invention is described with reference to FIGS. 3A to 4E.

First, as illustrated in FIG. 3A, a silicon wafer having a diameter of 150 mm and a thickness of 625 μm on which heater elements and driving circuits had been formed was prepared as a heater board (substrate 2).

On this heater board, a resin for forming the shapes of the tapered shape structures 3 was applied by spin-coating to form the resist layer 4. As the resin, a positive type resist produced by TOKYO OHKA KOGYO CO., LTD., OFPR-50 cp (trade name) was used. The number of revolutions of the spin coating was adjusted so that the film thickness of the resist layer 4 became 5 μm, provided that the baking temperature after applying the resin was 100° C. and the baking time was 10 minutes. After the application, the film thickness from the heater board 2 to the surface of the resist layer 4 was measured to be 5 μm.

This resist layer 4 was patterned by photolithography to form the resin pattern 5 for defining the shapes of the tapered shape structures 3 as illustrated in FIG. 3B (Step 1).

Next, as illustrated in FIG. 3C, the material layer 13 which becomes the filter 11 was formed by a spin-coating method. As a resin, a negative type resist SU-8 (trade name) produced by Kayaku MicroChem Corporation was used. In this case, the number of main revolutions was adjusted so that the film thickness of the material layer 13 from the surface of the substrate 2 became 6 μm, provided that the baking temperature after the application was 100° C. and the baking time was 100 minutes. Moreover, an entire exposure process and a baking process of 150° C. were performed to cure the material layer 13. After baking, the film thickness from the substrate 2 to the surface of the material layer 13 was measured to be 6 μm.

Figure 3D:
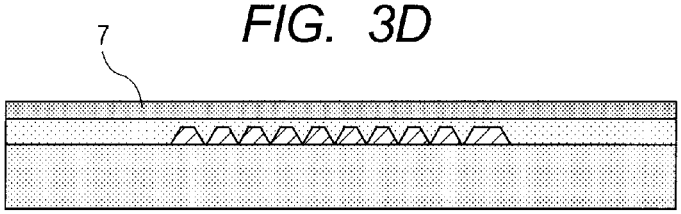

Next, as illustrated in FIG. 3D, the resin layer (resist layer) 7 for pattering the material layer 13 was applied by spin-coating. A positive type resist OFPR-50 cp (trade name) produced by TOKYO OHKA KOGYO CO., LTD. was applied as the resin. In this case, the number of revolutions of the spin-coating was 500 rpm, the baking temperature after the application was 100° C., and the baking time was 10 minutes.

Figure 3E:
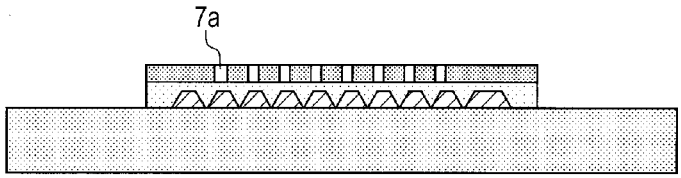

As illustrated in FIG. 3E, the resin layer 7 was patterned by photolithography to form the resin pattern 7*a*. Next, as illustrated in FIG. 4A, with this resin pattern 7*a* used as an etching mask, the openings 8 for ensuring the ink flow rate were formed so as to pass through the material layer 13 by reactive ion etching using fluorocarbon-based gas, to thereby form the filter 11 (Step 2). Note that, the opening shape of this opening 8 was a perfect circle whose minimum diameter and maximum diameter were substantially the same. The maximum opening diameter thereof was found to be 14 μm.

Next, as illustrated in FIG. 4B, a resin which becomes the mold of the ink flow paths 1*b* of the nozzle layer 1 was applied by a spin-coating method to form the mold 9 (Step 3). As the resin, a positive type Deep-UV resist ODUR-1010 (trade name) produced by TOKYO OHKA KOGYO CO., LTD. was used. The number of main revolutions was adjusted so that the film thickness after the application became 17 μm. The baking temperature after the application was 100° C. and the baking time was 3 minutes. In this case, the film thickness of the mold 9 from the surface of the substrate 2 after the application was measured to be 17 μm.

Next, this resist pattern (mold 9) was covered with a photosensitive resin, which becomes the nozzle layer 1 illustrated in FIG. 4C, by a spin-coating to form a photosensitive resin layer. As the resin, a negative type resist SU-8 (trade name) produced by Kayaku MicroChem Corporation was used. In this case, the number of main revolutions was adjusted so that the film thickness of this photosensitive resin layer from the surface of the substrate 2 became 30 μm. The baking temperature after the application was 150° C. and the baking time was 60 minutes. In this case, the film thickness of the photosensitive resin layer was measured to be 30 μm.

Using the mirror projection mask aligner, MPA600 (trade name) produced by Canon, the ink ejection orifices 1*a* were formed in the photosensitive resin layer, to thereby form the nozzle layer 1 provided with the ink ejection orifices 1*a* of a perfect circle having the opening shape whose minimum and maximum diameters were substantially the same (Step 4). When the diameter of the ejection orifice after its formation was measured, it was confirmed that even the minimum opening diameter was 15 μm which was larger than that of the opening 8 formed in the previously formed filter 11.

Next, as illustrated in FIG. 4D, the resultant substrate was immersed in methyl lactate while being subjected to ultrasonic waves, to thereby elute the mold 9 and the resin pattern 5 so that the ink flow path 1*b* was formed.

Then, by silicon anisotropic etching using tetramethylammonium hydroxide solution having a concentration of 25 mass % and liquid temperature of 80° C., the ink supply port 12 illustrated in FIG. 4E was formed in the substrate 2 to complete the nozzle tip (Step 5).

In Example 1, for easily understanding the summary of the invention, the nozzle tip was completed with the minimum steps. However, for ensuring a predetermined ink flow rate, it is possible to add some steps of additionally forming and removing a resist pattern between the filter layer and the mold, or between the mold and the photosensitive resin.

The nozzle tip was observed from the side of the ink supply port after completion, it was confirmed that the conical protruding portion serving as the tapered shape structures 3 and the openings 8 for allowing the passing of ink after removing dust therefrom were respectively formed.

Figure 6:
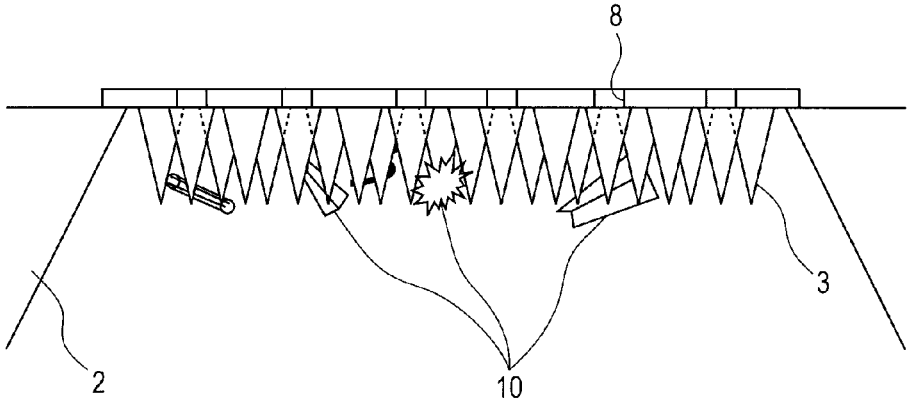
FIG. 6 is a cross-sectional view of an example of a filter layer for illustrating the filter layer used in the present invention.

Then, the nozzle tip manufactured in Example 1 was adhered with an adhesive to an ink supply member for supplying ink to complete the liquid ejection head, to thereby manufacture a print evaluation device incorporating the liquid ejection head. In this device, using ink of pure water/diethylene glycol/isopropyl alcohol/lithium acetate/black dye food black 2=79.4/15/3/0.1/2.5, a printing test was performed under the conditions of ruled line printing and dot printing. As a result, as illustrated in a schematic diagram of FIG. 6, it was possible to collect dust 10 in ink by the tapered shape structures 3 so that the ink flow rate was not decreased even after collecting dust, and excellent ink ejection could be performed without blurs or unevenness of printing.

The present invention can be applied to an ink jet recording head for ejecting recording liquid to be used in an ink jet recording system.

According to the present invention, there are provided a liquid ejection head and a manufacturing method thereof in which a filter is prevented from being clogged when dust and foreign matters in liquid are collected so that, even after collecting dust, the liquid flow rate is not decreased and a stable ejection of liquid can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-064162, filed Mar. 23, 2011, which is hereby incorporated by reference herein in its entirety.

What is claimed is:

1. A liquid ejection head, comprising:

an ejection orifice forming member having an ejection orifice for ejecting liquid;

a substrate having a supply port for supplying the liquid to the ejection orifice; and a filter disposed at a position upstream of the ejection orifice when the liquid is supplied to the ejection orifice, wherein the filter includes an opening having a diameter smaller than or equal to a diameter of the ejection orifice, and a tapered shape structure disposed at a position upstream of the opening when the liquid is supplied to the ejection orifice, the tapered shape structure having a distal end directed toward an upstream side.

2. The liquid ejection head according to claim 1, wherein three or more said tapered shape structures are disposed for one said opening, and respective protruding bodies are formed so as to surround the opening.

3. The liquid ejection head according to claim 1, wherein an angle formed outside the tapered shape structure by a side surface of the tapered shape structure and a surface of a filter layer on the tapered shape structure side in which the opening is formed is an obtuse angle.

* * * * *